United States Patent [19]

Puri et al.

[11] Patent Number: 5,014,788

[45] Date of Patent: May 14, 1991

[54] METHOD OF INCREASING THE PERMEABILITY OF A COAL SEAM

[75] Inventors: Rajen Puri; Dan Yee; Thomas S. Buxton, all of Tulsa, Okla.; Om Majahan, Wheaton, Ill.

[73] Assignee: Amoco Corporation, Chicago, Ill.

[21] Appl. No.: 511,497

[22] Filed: Apr. 20, 1990

[51] Int. Cl.[5] ..... E21B 43/25; E21B 43/26; E21B 43/27

[52] U.S. Cl. ..... 166/308; 166/305.1; 166/307; 299/12

[58] Field of Search ..... 166/307, 308, 256, 259, 166/271, 305.1; 299/12

[56] References Cited

U.S. PATENT DOCUMENTS 4,283,089 8/1981 Mazza et al. ..... 166/308 X 4,400,034 8/1983 Chew ..... 166/307 X

*Primary Examiner*—George A. Suchfield

*Attorney, Agent, or Firm*—Scott H. Brown; Fred E. Hook

[57] ABSTRACT

A method of increasing the rate of methane production from a coal seam includes introducing a desired volume of a gas, that causes coal to swell, into the coal seam adjacent a wellbore, maintaining the coal seam adjacent the wellbore in a pressurized condition for a period of time to permit the gas to contact a desired area of the coal adjacent the wellbore, and relieving the pressure within the coal seam by permitting fluids to flow out from the wellbore at a rate essentially equivalent to the maximum rate permitted by the wellbore and any surface wellbore flow control equipment. Uneven stress fractures should be created in the coal by this method which will increase the near wellbore permeability of the coal seam.

31 Claims, 4 Drawing Sheets

METHOD OF INCREASING THE PERMEABILITY OF A COAL SEAM

BACKGROUND OF THE INVENTION 1. FIELD OF THE INVENTION

The present invention is directed to methods of increasing the rate of production of methane from a subterranean coal seam, and more particularly, to such methods that use the injection and production of a gas which causes the coal to swell and shrink near the wellbore.

2. SETTING OF THE INVENTION

Subterranean coal seams contain substantial quantities of natural gas, primarily in the form of methane. The methane is sorbed onto the coal and various techniques have been developed to enhance the production of the methane from the coal seam. These various techniques all attempt to increase the near wellbore permeability of the coal, which will permit an increase in the rate of production of methane from the coal seam. One technique is to hydraulically fracture the coal by the injection of liquids or gels with proppant into the coal seam. Although hydraulic fracturing of coal seams is most often effective in increasing the near wellbore permeability of the coal, it is not always economical if the thickness of the coal seam is thin, e.g., less than about five feet. Furthermore, hydraulic fracturing of the coal is not environmentally desirable when there is an active aquifer immediately adjacent to the coal seam because the created fractures may extend into the aquifer which will then permit unwanted water to invade the coal seam and the wellbore. Further, some laboratory evidence suggests that fracturing fluids can lead to long term loss in coal permeability due to sorption of the fracturing fluids in the coal matrix causing swelling, and due to the plugging of the coal cleat or natural fracture system by unrecovered fracturing fluids.

Another technique to stimulate coalbed methane production from a wellbore is to inject a gas, such as air, ammonia or carbon dioxide, into the coal seam to fracture the coal seam. This technique has been utilized primarily to degassify coal mines for safety reasons. U.S. Pat. No. 3,384,416 discloses such a technique where a refrigerant fluid with proppant is injected into the coal seam to fracture the coal. The injected refrigerant fluid and methane are permitted to escape from a borehole under its own pressure or the fluid and methane may be removed with the help of pumps.

U.S. Pat. No. 4,083,395 discloses a technique for recovering methane from a coal seam where a carbon dioxide-containing fluid is introduced into the coal deposit through an injection well and held therein for a period sufficient to enable a substantial amount of methane to be desorbed from the surfaces of the coal deposit Following the hold period, the injected carbon dioxide-containing fluid and desorbed methane are recovered through a recovery well or wells spaced from the injection well. The process is repeated until sufficient methane has been removed to enable safe mining of the coal deposit.

SUMMARY OF THE INVENTION

The present invention is a method of increasing the rate of production of methane from a subterranean coal seam. Within the method of the present invention, a predetermined volume of gas that cause coal to swell is introduced into a coal seam through a wellbore. The rate of injection of the gas is controlled such that the adsorption and swelling of the coal is maximized adjacent the wellbore. The pressure within the coal seam is maintained so that the desired volume of the gas will contact a desired area of the coal seam adjacent the wellbore. The pressure within the coal seam is relieved prior to the pressure within the coal seam decreasing to some stabilized pressure by permitting the injected gas and other fluids to flow out from the wellbore at a rate essentially equivalent to the maximum rate permitted by the wellbore and surface wellbore flow control equipment. A relatively rapid outflow of fluids is desired and is believed to cause uneven stress fractures within the coal, formation of hydrates with the natural coal fracture system and dissolution of some mineral matter within the coal by action of a created acid solution, all of which are believed to increase the near wellbore permeability of the coal.

The method of the present invention can be used in thin coal seams, in coal seams adjacent to aquifers, is suited to wells with either cased-hole or open-hole completion, is suited to be used as a workover technique on previously hydraulically fractured coal seams, and does not require the use of liquids and gels that could potentially decrease coal permeability.

DETAILED DESCRIPTION OF THE PREFERRED EMBODIMENTS

Figure 1:
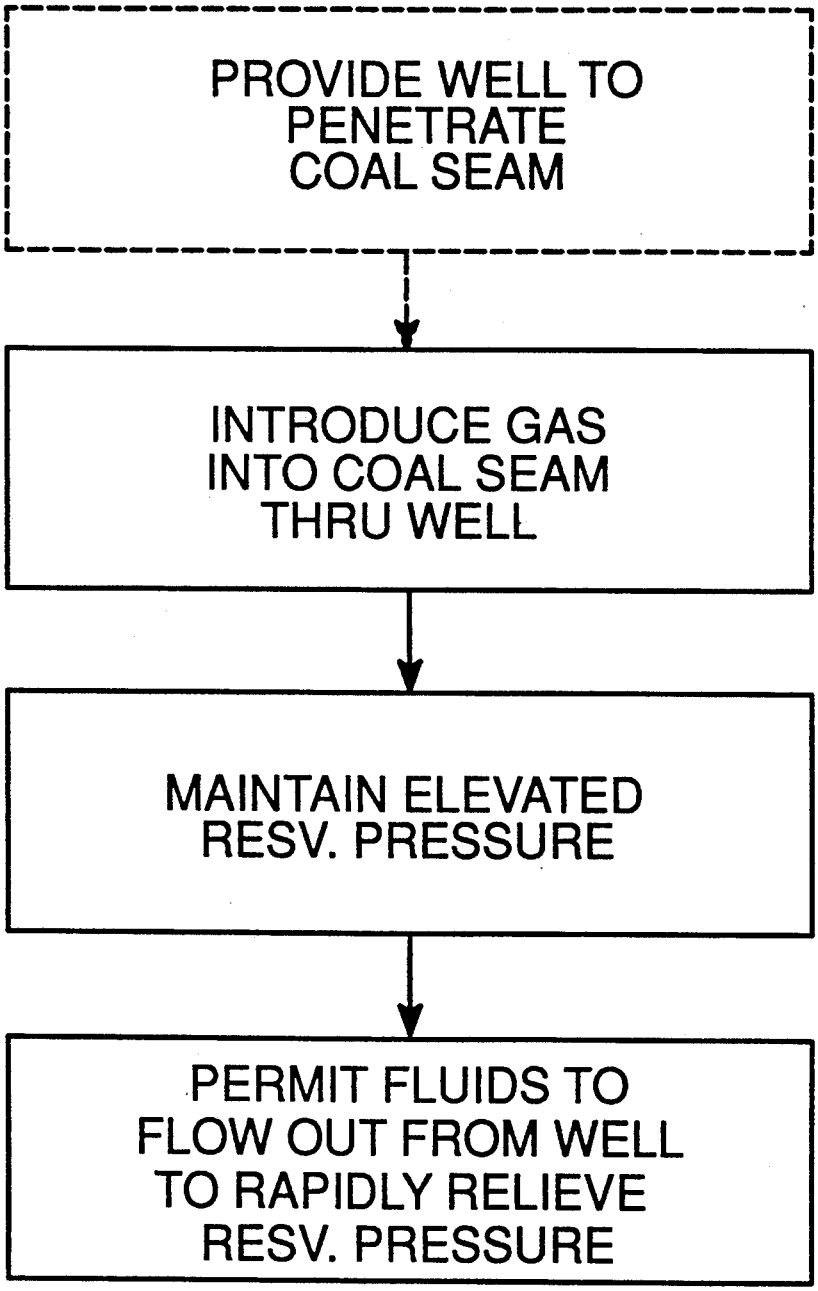
FIG. 1 is a flow chart illustrating the sequence of steps used in a preferred embodiment of the present invention.

The present invention is a method of increasing the rate of production of methane from a coal seam. The method of the present invention, as shown in the flow chart of FIG. 1, involves the introduction of a predetermined volume of gas, that causes coal to swell, into a subterranean coal seam adjacent a wellbore. The rate of injection of the gas is controlled such that the adsorption and swelling of the coal is maximized adjacent the wellbore. The pressure within the coal seam is maintained above an initial wellbore pressure so that the desired volume of the gas will contact a desired area of the coal seam adjacent the wellbore. The pressure is relieved prior to the pressure within the coal seam decreasing to some stabilized pressure by permitting the injected gas and other fluids to flow out from the wellbore at a rate essentially equivalent to a maximum rate permitted by the wellbore and surface wellbore flow control equipment.

The inventors hereof believe that a relatively rapid reduction in the pressure is preferred in order to create uneven stress fractures, form hydrates in the coal cleat system adjacent the wellbore, and dissolve mineral matter.

As used herein, uneven stress fractures are any opening, crack, fracture, or other physical change in the coal matrix caused by an applied chemical or physical alteration, such as subjecting one portion of the coal to a greater quantity of stress than another portion of the coal seam. The inventors hereof believe that in actual field use of the present invention the enhancement of the fractures near the wellbore will directly cause an increase in the production of methane. Specifically, the enhancement of the fractures near the wellbore are believed to be caused by (1) uneven swelling and shrinking of the heterogeneous coal matrix near the wellbore caused by the sorption and desorption of the swelling gas, (2) the formation of gas hydrates in the coal matrix due to the Joule-Thompson cooling effect created by a rapid depressurization of the coal seam, and (3) leaching of some of the mineral matter within the coal matrix by acidic solutions, such as carbon dioxide dissolved in water. The inventors hereof believe that these three phenomenon acting individually or in some combination can cause the increase in the near wellbore permeability of the coal seam, which will permit an increase in the rate of methane production from the coal seam.

Due to the nonhomogenous nature of coal, the swelling of the coal will most likely be uneven. This uneven swelling of the coal will place certain portions of the coal under more stress than adjacent portions, which will lead to the formation of the desired uneven stress fractures.

As used herein, the term sorbed means any physical or chemical phenomenon where the gas becomes held internally with the coal matrix or externally on the outer surface of the coal. Examples of this phenomenon include adsorption on the coal particle surface, absorption by penetration of the gas into the lattice structure of the coal, and capillary condensation within the pores of the coal.

The gas that causes coal to swell can be any gas that when placed in contact with coal will cause the coal matrix to be enlarged by a physical swelling of the coal. This coal swelling phenomenon is well known, and is described in Revcroft & Patel, "Gas Induced Swelling In Coal", FUEL, Vol. 65, June 1986. The gas preferred for use is any essentially pure gas or gas mixture that has as a major constituent a gas selected from the group including carbon dioxide, xenon, argon, neon, krypton, ammonia, methane, ethane, propane, butane, or combinations of these. Due to its wide availability, relatively inexpensive cost, great swelling reactivity with coal, and its ability to go into solution with water in the coal seam, a preferred gas contains as a major constituent carbon dioxide, and essentially pure carbon dioxide is most preferable.

Figure 2:
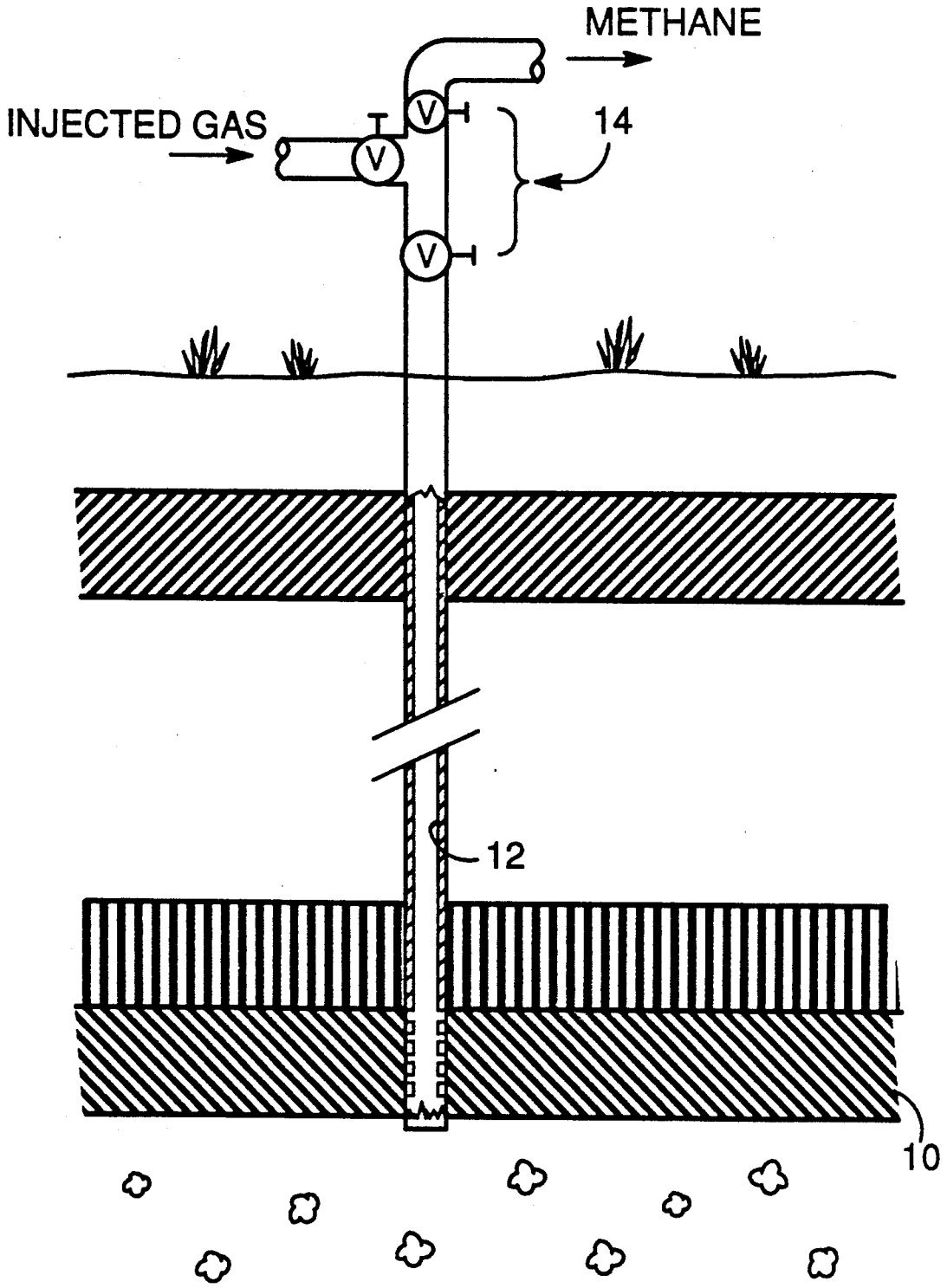
FIG. 2 is a diagrammatical elevational view of a wellbore penetrating a subterranean coal seam; the wellbore including surface wellbore flow control equipment utilized in the practice of the present invention.

In a preferred embodiment of the present invention, a gas that causes coal to swell is introduced, as shown in FIG. 2, into a subterranean coal seam 10 through a wellbore 12, which includes surface wellbore flow control equipment 14, such as valves, chokes and the like, as all are well known to those skilled in the art. While the wellbore 12 is shown in FIG. 2 as being cased, this method can also be utilized in open hole (uncased) wellbores. The gas is injected at a pressure above the initial wellbore pressure, which can also be referred to as the reservoir pressure or the hydrostatic pressure, of the coal seam and preferably below the fracture pressure of the coal seam. The present invention is primarily directed to treating the coal seam adjacent the wellbore, so injecting the gas above the fracture pressure is not preferred because the gas will be displaced away from the immediate wellbore vicinity. This would require a far greater quantity of gas than would be needed to treat the near wellbore vicinity if the introduction pressure is primarily maintained below the fracture pressure. Typical injection pressures are from about 100 psig to about 2,000 psig bottomhole pressure.

An alternate embodiment to that described above is to inject a major portion of the gas, such as about 80% volume to 95% volume, above the initial wellbore pressure but below the coal's fracture pressure, and then inject a following minor portion, 5% volume to 20% volume, at a pressure greater than the fracture pressure without proppant to temporarily fracture the coal seam after the coal adjacent to the wellbore has been contacted by the introduced gas. This two-step injection procedure is believed to facilitate the subsequent depressurization of the coal seam. A relatively small volume of gas, in the range of about one to about five million standard cubic feet, is contemplated to be injected to allow coal within a radius of about 25 to about 50 feet from the wellbore to be soaked, i.e., saturated with the gas. Further, the gas injection rate is controlled to maximize the sorbtion and swelling of the coal adjacent the wellbore. Typical injection rates are from about 0.5 MMCF to about 5.0 MMCF per day. And, injection duration are preferably from about 12 to about 22 hours, with most preferable being about 24 to about 48 hours. The rate and pressure of gas injection depends upon the particular thickness and type of coal, physical configuration and size of the wellbore and injection equipment, as well as its in-situ reservoir conditions, such as pressure and temperature.

The pressure within the coal seam is maintained above the initial wellbore pressure by the continued introduction of the gas or by ceasing the introduction and closing the appropriate surface valves from about two hours to about twenty-four hours or more so that a desired volume of the gas will contact a desired area of the coal seam adjacent the wellbore. During this time, methane desorption and gas sorption is believed to occur to a desired distance out from the wellbore. The bottomhole pressure within the coal seam during this period can be maintained at essentially a constant bottomhole pressure or can be altered, such as by increasing and decreasing the injection pressure of the gas, or by injecting and then relieving the wellbore pressure by bleeding off gas in a cycle. The inventors hereof believe that this pressure cycling can increase the quantity and size of the uneven stress fractures within the coal seam as part of the preferred method.

In any coal seam, the injected gas will flow outwardly away from the wellbore, so that when the introduction of the gas is ceased, the bottomhole pressure will slowly decrease to approach a stabilized pressure, which will be the new ambient wellbore pressure. After the coal has been contacted by the gas to the distance desired, and prior to the pressure decreasing to the stabilized pressure, the pressure within the coal seam is relieved by permitting fluids to flow out through the wellbore 12. These fluids include the injected gas, methane and other natural gases, water vapor, and any other in-place fluids. The relieving of the pressure is accomplished by opening of appropriate valving 14 on a wellhead connected to the wellbore 12, and also, if desired, activating submersible or surface pumping units in accordance with methane recovery methods that are well known.

The inventors hereof believe that the relieving of the pressure of the coal seam should be achieved as rapidly as possible, for example, from about 1500 psig to about 150 psig bottomhole pressure in about two hours or less. Rapid depressurization is thought to be beneficial because coal is heterogeneous, and thus will swell and shrink unevenly. So, if the coal is allowed to shrink rapidly, the difference in the magnitude of the swelling and shrinking of the various portions of the coal seam will result in the creation of the desired uneven stress fractures adjacent the wellbore and therefore will cause an increase in the near wellbore permeability.

Further, the rapidly escaping fluids, primarily gases, will tend to cool the coal seam adjacent to the wellbore, due to the Joule-Thompson expansion effect. This cooling can cause the formation of ice crystals (if below 32° F.) and gas hydrates (at temperatures above 32° F.). Gas hydrates are formed when a molecule of the injected gas becomes caged within one or more molecules of water to form a crystal. The volumetric expansion of fluids as a result of the formation of ice crystals and gas hydrates is believed to enhance the natural fracture network of the coal near the wellbore. The cracking and fracturing of the coal due to the creation of ice crystals, and especially gas hydrates, is analogous to the cracking of roads, sidewalks, driveways, etc., in the winter by the freezing and thawing of water.

For example, the temperature-entropy diagram for pure carbon dioxide, carbon dioxide at 110° F. and 1500 psig will cool to about 5° F. if it is expanded adiabatically to 150 psig. Although it is difficult to ascertain the exact temperatures at which the gas and water will cool during the flowback of the gas and other fluids from the well during the depressurization of the coal in the preferred method, it is believed that some beneficial formation of gas hydrates will occur. Gas hydrates are believed to occur in the practice of the present invention, because in laboratory tests, gas hydrates will occur at a temperature of about 50° F. utilizing a gas containing 90% volume carbon dioxide and 10% volume methane at a pressure greater than 670 psig. Carbon dioxide and propane will lead to the formation of gas hydrates at even higher temperatures. For example, a gas mixture of 10% volume methane, 10% volume propane, and 80% volume carbon dioxide will form gas hydrates at 1330 psig and 60° F.

Additionally, the inventors believe that if the coal seam adjacent to the wellbore is cooled, then the beneficial formation of ice crystals and/or gas hydrates within the coal seam will be increased. This cooling is preferably accomplished by introducing a gas at a temperature below that of the coal seam adjacent to the wellbore. The cooling gas can be introduced prior to, as part of, or after the injection of the gas prior to shutting in the wellbore to maintain the pressure. Due to cost and transportation systems available, liquid carbon dioxide is preferably used as the cooling gas because the liquid carbon dioxide containers can be connected to the wellbore and the liquid carbon dioxide can be injected directly into the wellbore and into the coal seam.

By selecting for injection a gas that can form an acidic solution such as carbon dioxide in solution with water, another beneficial physical mechanism described previously can be utilized to increase the coal's permeability. In "Determination of the Effect of Carbon Dioxide/Water On the Physical and Chemical Properties of Coal", Brookhaven National Laboratories 39196, 1986, the authors describe a procedure where carbon dioxide gas dissolved in water leached anywhere from 18% to 20% of the mineral matter from the coal. This leaching by the acidic solution within the coal will enhance the natural fracture network of the coal and thereby increase the permeability of the coal seam adjacent to the wellbore.

TEST 1

To illustrate the effectiveness of using one embodiment of the present invention, a test was conducted on a 2 in. diameter × 4½ in. long coal core from Black Warrior Basin, Ala. The coal core was placed under hand induced torsional pressure to determine that it was rigid and strong, and that it would not readily break apart. The coal core was placed within a pressure cell at pressures ranging from 912 psig to 946 psig with a mixture of essentially pure carbon dioxide and some water vapor for 100 hours. The pressure cell valving was then quickly opened fully to rapidly depressurize the pressure cell to atmospheric pressure within 1½ minutes to simulate rapidly releasing the pressure within the coal seam. After removal of the coal core from the test cell, the coal core partially disintegrated with handling. The increase in the friability of the coal illustrates the ability of the method of the present invention to create uneven stress fractures within the coal which can then increase the permeability of the coal seam adjacent the wellbore.

The present invention as described above is contemplated to be used with coalbed methane recovery methods, as are well known, before a methane recovery project is started or when desired during the life of the methane recovery project.

TEST 2

To prove that the rate of methane production can be increased from an actual subterranean coal seam, the following field test was conducted. A coalbed methane production well in the San Juan Basin, N.Mex. was selected. The well had been previously fracture stimulated using gel and sand proppant and put on production. Artificial water lift equipment was installed since the well repeatedly failed to freely flow methane. Over most of the production life of the well, the well had been a steady producer of about 132 MCF/D of methane and 34 BPD of water (average daily production over past six months).

After checking for coal fines in the wellbore, approximately 115 tons of liquid $CO_2$ (2.0 MMSCF) were injected into the wellbore in about 6 hours at a rate of 2.0–2.4 bpm. The surface wellhead pressure remained at about 500 psig throughout the injection. Since liquid $CO_2$ has a density of 8.46 lbs/gal at 2° F., the pressure at the coal seam during the $CO_2$ injection was estimated to be no more than about 1800 psig bottomhole pressure. In order to facilitate the flow-back of fluids, approximately 10 tons (176 MSCF) of $CO_2$ were injected at a wellhead pressure of 1400 psig. The coal's fracture parting pressure was estimated to be about 950 psig wellhead pressure (2260 psig bottomhole pressure).

After the well was shut-in for 18 hours, it was allowed to flow-back as rapidly as possible. No operational difficulties were experienced during the entire $CO_2$ procedure. Coal fines production was not reported during or after the $CO_2$ flow-back. Unfortunately, the $CO_2$ injection was conducted at such high rates that the entire liquid volume was pumped in less than 6 hours, instead of the preferable 24 hours believed to maximize the CO2 sorbtion by coal adjacent to the wellbore.

Figure 3:
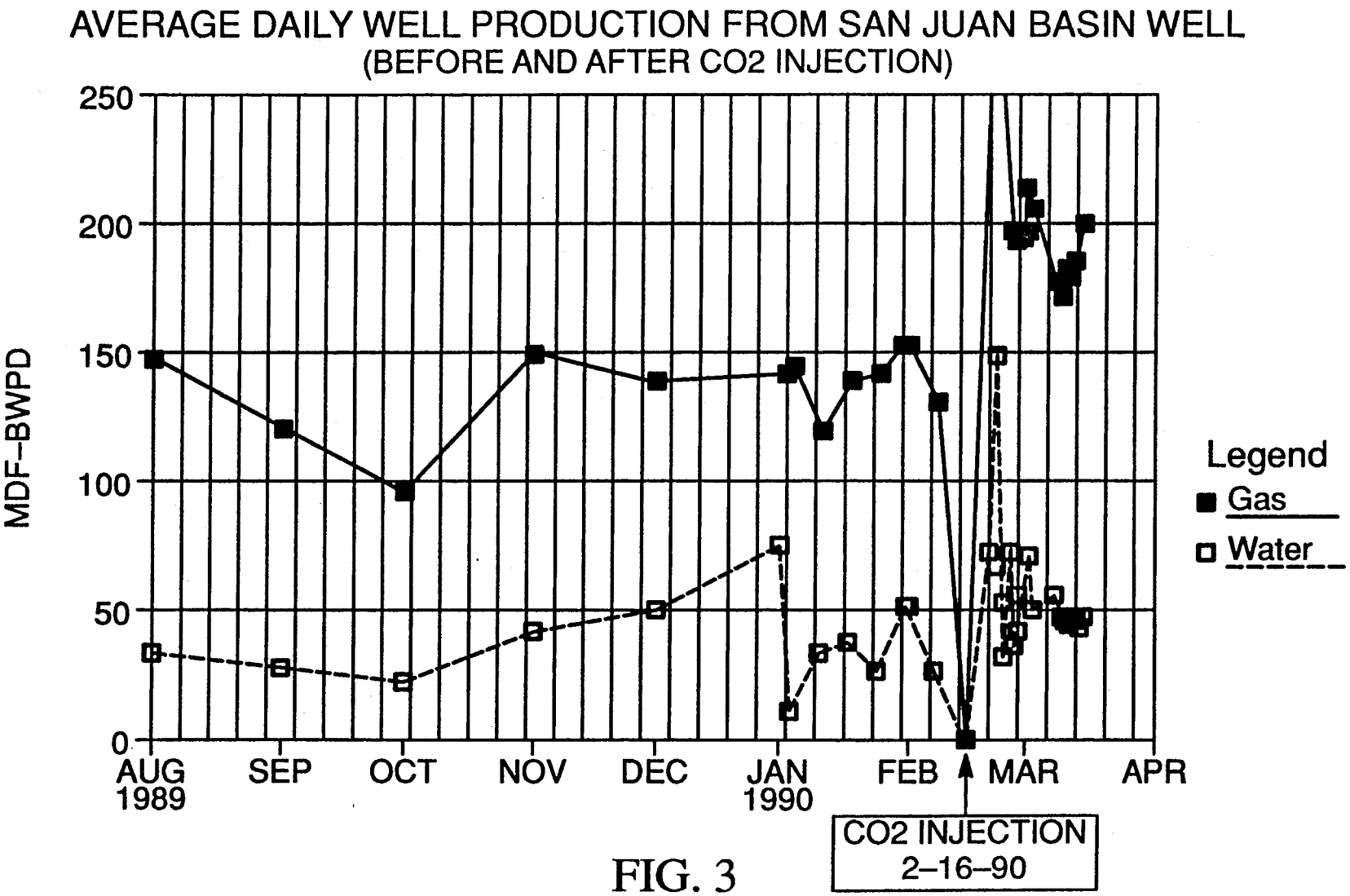
FIG. 3 is a graphical representation of the average daily methane and water production for a well before and after the coal was treated in accordance with one embodiment of the present invention.

Since the above procedure was completed, the well has been flowing methane and water without the aid of artificial water lift equipment for over a month. The carbon dioxide concentration in the produced gas decreased rapidly to 15% vol. in 4 days and was less than 7% vol. in less than about a month, about the same level as before the CO2 injection. Even though the flowing surface tubing pressure (150 psig) is greater than prior to the procedure (100 psig), and no effort has yet been made to reduce (or measure) fluid levels in the wellbore, gas production has been about or greater than 200 MCF/D over the month (FIG. 3). This gas production rate is lifting about 50 barrels of water per day from the wellbore. The initial response from the well is highly encouraging. Not only is the post-CO2 injection gas rate almost 50% higher, 200 MCF/D versus 132 MCF/D, but the well may produce even more gas and water if the flowing tubing pressure can be reduced and water level in the well reduced.

An alternate embodiment of the present invention is as a work-over technique to treat coal adjacent a wellbore that has been damaged by materials and fluids used in drilling, in previous hydraulic fracturing treatments, or in other work-over techniques. In this alternate embodiment, the coal seam is treated to remove undesired gels and fluids remaining after a well is drilled, contemplated and stimulated. First, a gas that causes coal to swell is introduced into the coal seam through the wellbore as previously described. The pressure within the coal seam is maintained, and then, relieved by permitting the gas to flow out from the wellbore at a rate essentially equivalent to a maximum flow rate permitted by the physical configuration and sizing of the wellbore and surface wellbore flow control equipment, again as previously described.

When the coal seam is depressurized, preferably rapidly, the rapid outflow of liquids and gases from the coal seam will entrain and transport the remaining gels and fluids, coal fines and other materials in the coal adjacent the wellbore. The previously described alternative embodiments can also be used in the practice of this workover method. Further, the introduction of the gas can be at pressures above the fracture pressure to ensure that the entire length of any previously created fractures distant from the wellbore are contacted by the gas and subject to the outflow of fluids when the coal seam is rapidly depressurized.

TEST 3

Figure 4:
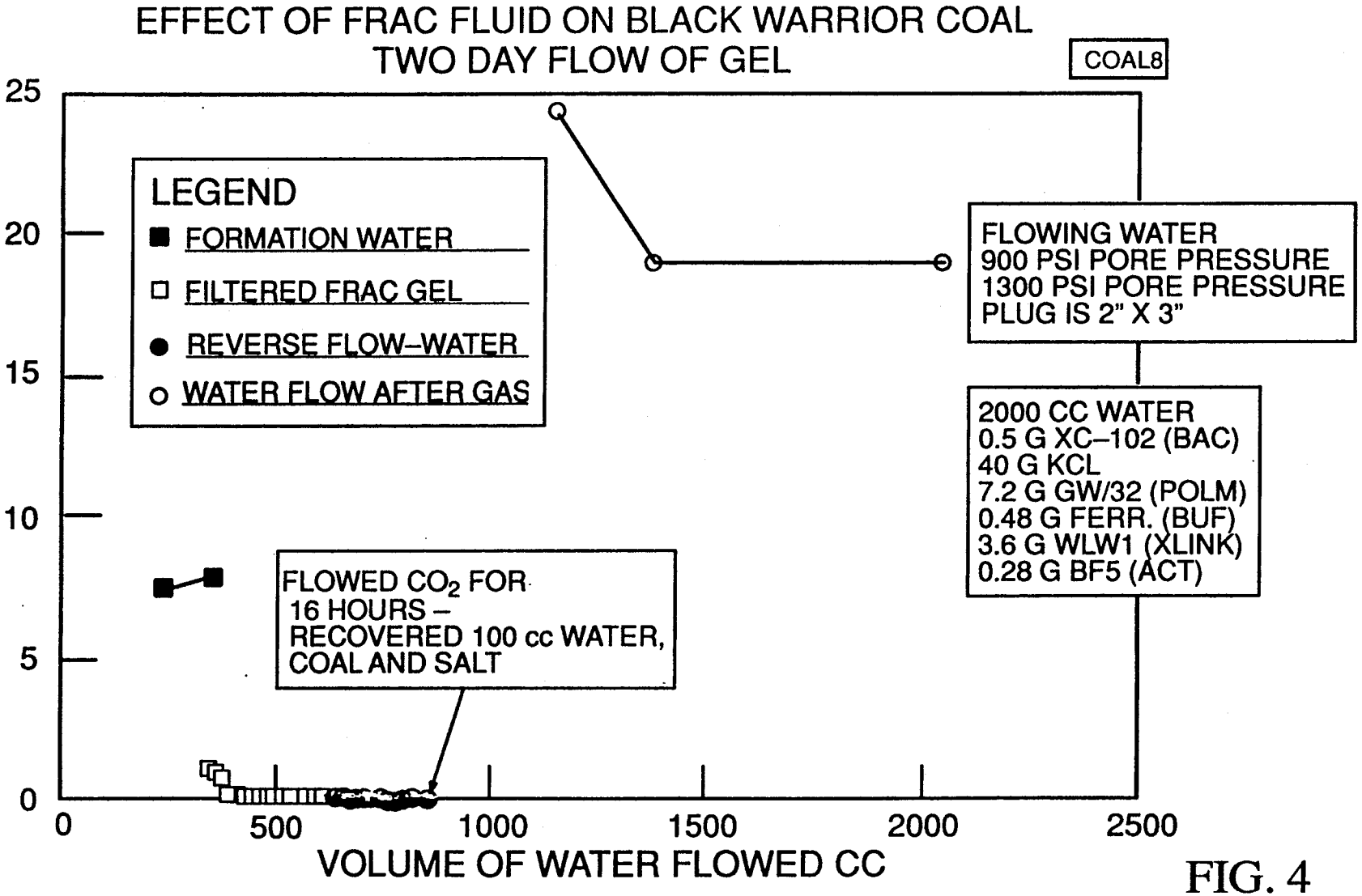
FIG. 4 is a graphical representation of the volume of water flowed through a coal sample versus permeability before and after the coal sample was treated in accordance with one embodiment of the present invention.

To illustrate the permeability restoring benefits of the above described workover method, a 2 in. diameter ×3 in. long coal core from Black Warrior Basin, Ala., having a permeability of about 7.5 md was placed in a test cell and maintained at about 1300 psig to simulate overburden with a resulting pore pressure of between about 890 psig and about 910 psig. The coal core was maintained at room temperature and a filtered and broken fracturing gel fluid at 80° F. was injected into the coal core. As shown in FIG. 4, the permeability of the coal core was decreased from about 7.5 md to about 0.01 md. The inventors believe this reduction of the permeability is the result of the swelling of the coal matrix, as well as the blocking of the coal's natural fracture system by the fracturing fluid.

The fracturing fluid was flowed through the coal core for about 48 hours. Attempts to restore the permeability of the coal by water flush failed. When about 400 cc (about 130 pore volumes) of fracturing fluid was permitted to flow out from the test cell, as shown in FIG. 4, no increase in permeability was observed. Carbon dioxide gas was flowed through the coal core at room temperature for 16 hours at about 750 psig. The gas injection was ceased and the pressure was maintained for a few hours. Then, the pressure was released to atmospheric pressure in about 5 minutes and approximately 100 cc of water, coal fines, fracturing fluid, and other debris were recovered from the cell. Thereafter, the permeability of the coal core was measured and was found to stabilize at about 19 md, which was substantially above the 0.01 md previous damaged permeability and further above the original 7.5 md permeability.

From the above discussion and tests, it can be appreciated that the present invention provides a method for treating a coal seam to increase the rate of methane production, which can be accomplished in a timely and environmentally compatible manner. Further, the present invention provides a method of treating a previously damaged coal seam to restore and possibly increase its near wellbore permeability to increase the rate of methane production.

Whereas the present invention has been described in particular relation to the drawings attached hereto and the above described examples, it should be understood that other and further modifications, apart from those shown or suggested herein, may be made within the scope and spirit of the present invention.

What is claimed is:

1. A method of increasing the rate of methane production from a subterranean coal seam penetrated by a wellbore, the method comprising:

(a) introducing fluid that causes coal to swell into the subterranean coal seam through the wellbore at a pressure above ambient reservoir pressure at the wellbore and below a fracture pressure of the coal seam;

(b) maintaining the injected fluid in the coal seam in a pressurized condition so that the fluid will contact the coal seam; and (c) relieving the pressure within the coal seam by permitting the fluid to flow out from the wellbore prior to the pressure within the coal seam decreasing to a stabilized pressure.

2. The method of claim 1 wherein the pressure is relieved at a rate essentially equivalent to a maximum flow rate permitted by the wellbore and surface wellbore control equipment.

3. The method of claim 1 wherein the pressure is relieved at a rate sufficient to cause uneven stress fractures within the coal seam adjacent the wellbore.

4. The method of claim 1 wherein the fluid contains as a major constituent a fluid selected from the group consisting of carbon dioxide, xenon, argon, neon, krypton, ammonia, methane, ethane, propane, butane, and combinations of these.

5. The method of claim 1 wherein the fluid is liquid carbon dioxide.

6. The method of claim 1 wherein in step (a) about 80% volume to about 95% volume of the fluid is injected below the fracture pressure of the coal seam, and about 5% volume to about 20% volume of the fluid is injected above the fracture pressure of the coal seam.

7. The method of claim 1 wherein from about 1 to about 5 million standard cubic feet of the fluid is injected in step (a).

8. The method of claim 1 wherein a desired radius of contact of the fluid around the wellbore is from about 25 ft. to about 50 ft.

9. The method of claim 1 wherein the fluid is injected at a rate of from about 0.5 MMCF per day to about 5.0 MMCF per day.

10. The method of claim 1 wherein the duration of the fluid injection is from about 24 to about 48 hours.

11. The method of claim 1 wherein in step (c) the pressure is relieved by opening valves operatively connected to a wellhead operatively connected to the wellbore.

12. The method of claim 1 wherein in step (c) the pressure is relieved from at least about 15,000 psig to about 150 psig reservoir pressure at the wellbore in about 2 hours or less.

13. The method of claim 1 wherein the fluid forms acidic solutions with water in the coal seam.

14. A method of increasing the permeability of a coal seam adjacent to a wellbore comprising:

(a) introducing fluid that causes coal to swell into a subterranean coal seam through a wellbore;

(b) maintaining the injected fluid within the coal seam in a pressurized condition to permit the fluid to contact the coal seam to a desired distance from the wellbore; and (c) relieving the pressure within the coal seam by permitting the fluid to flow out from the wellbore at a rate sufficient to increase the permeability of the coal seam adjacent the wellbore.

15. The method of claim 14 wherein the fluid is introduced in step (a) at a pressure above an ambient reservoir pressure at the wellbore and below a fracture pressure of the coal seam.

16. The method of claim 14 wherein a major volume portion of the fluid is introduced in step (a) at a pressure below a fracture pressure of the coal seam, and a following minor volume portion of the fluid is introduced at a pressure above the fracture pressure of the coal seam.

17. The method of claim 14 wherein the fluid contains as a major constituent a fluid selected from the group consisting of carbon dioxide, xenon, argon, neon, krypton, ammonia, methane, ethane, propane, butane, and combinations of these.

18. The method of claim 14 wherein the fluid is essentially pure carbon dioxide.

19. The method of claim 14 wherein step (a) includes cooling the coal seam adjacent the wellbore by introducing the fluid at a temperature below that of the coal seam adjacent the wellbore.

20. The method of claim 19 wherein the coal seam adjacent to the wellbore is cooled by the introduction of liquid carbon dioxide into the wellbore.

21. The method of claim 14 wherein step (b) includes varying the pressure within the coal seam.

22. The method of claim 21 wherein the pressure within the coal seam is varied by cyclically introducing the gas into the coal seam and relieving a portion of the pressure by permitting a portion of the gas to flow out from the wellbore.

23. The method of claim 14 wherein the pressure in step (c) is relieved at a rate sufficient to cause cooling of in-place fluids within the coal seam adjacent the wellbore.

24. The method of claim 14 wherein the pressure in step (c) is relieved at a rate sufficient to cause the formation of gas hydrates within the coal seam adjacent the wellbore.

25. A workover method for increasing the rate of methane production from a coal seam, the coal seam having been treated by a prior hydraulic fracturing process, the workover method comprising:

(a) introducing fluid that causes coal to swell into the subterranean coal seam through a wellbore at a pressure above ambient reservoir pressure at the wellbore and below a fracture pressure of the coal seam;

(b) maintaining the injected fluid in the coal seam in a pressurized condition to permit the fluid to contact a desired area of the coal seam adjacent the wellbore and (c) relieving the pressure within the coal seam at a rate sufficient to remove residue remaining from the prior hydraulic fracturing process from the coal seam adjacent the wellbore.

26. A method of increasing the rate of methane production from a subterranean coal seam penetrated by a wellbore, the method comprising:

(a) introducing a fluid consisting essentially of liquid carbon dioxide into the subterranean coal seam through the wellbore at a pressure above ambient reservoir pressure at the wellbore and below a fracture pressure of the coal seam;

(b) maintaining the fluid in a pressurized condition within the coal seam so the fluid will contact the coal seam adjacent the wellbore; and (c) relieving the pressure within the coal seam by permitting the fluid to flow out from the wellbore prior to the pressure within the coal seam decreasing to a stabilized pressure and at a rate essentially equivalent to a maximum flow rate permitted by the wellbore and surface wellbore control equipment.

27. The method of claim 26 wherein the fluid is injected at a rate of from about 0.5 MMCF per day to about 5.0 MMCF per day.

28. The method of claim 27 wherein from about 1 to about 5 million standard cubic feet of the fluid is injected in step (a).

29. The method of claim 28 wherein the duration of the fluid injection is from about 24 to about 48 hours.

30. The method of claim 29 wherein in step (c) the pressure is relieved by opening valves operatively connected to a wellhead operatively connected to the wellbore.

31. The method of claim 30 wherein in step (c) the pressure is relieved from at least about 15,000 psig to about 150 psig reservoir pressure at the wellbore in about 2 hours or less.

* * * * *